US010151056B2

(12) United States Patent
Yamazaki

(10) Patent No.: US 10,151,056 B2
(45) Date of Patent: Dec. 11, 2018

(54) SEWING MACHINE FOR SEWING TOGETHER A PLURALITY OF CLOTH PIECES

(71) Applicant: AXE YAMAZAKI CO., LTD., Osaka-shi (JP)

(72) Inventor: Norio Yamazaki, Osaka (JP)

(73) Assignee: AXE YAMAZAKI CO., LTD., Osaka (JP)

( * ) Notice: Subject to any disclaimer, the term of this patent is extended or adjusted under 35 U.S.C. 154(b) by 0 days.

(21) Appl. No.: 15/706,363

(22) Filed: Sep. 15, 2017

(65) Prior Publication Data

US 2018/0002852 A1 Jan. 4, 2018

Related U.S. Application Data

(63) Continuation of application No. PCT/JP2015/086019, filed on Dec. 24, 2015.

(30) Foreign Application Priority Data

Mar. 24, 2015 (JP) ..... 2015-060414
Sep. 28, 2015 (JP) ..... 2015-189692

(51) Int. Cl.
*D05B 1/00* (2006.01)
*D04H 18/02* (2012.01)
(Continued)

(52) U.S. Cl.
CPC ..... *D04H 18/02* (2013.01); *D05B 23/00* (2013.01); *D05B 3/12* (2013.01)

(58) Field of Classification Search
CPC . D05B 23/00; D05B 3/12; D04H 5/02; D04H 18/02
(Continued)

(56) References Cited

U.S. PATENT DOCUMENTS 3,318,274 A * 5/1967 Schoij ..... D05B 51/00 112/221
4,108,096 A * 8/1978 Ciecior ..... D05B 3/02 112/221
(Continued)

FOREIGN PATENT DOCUMENTS

DE 2853486 A1 * 6/1979 ..... D04D 7/02
JP 56-173399 5/1980
(Continued)

OTHER PUBLICATIONS

Japanese Office Action dated Jan. 25, 2016 in Japanese Application No. 2015-189692 (Translation Only), 2 pages.
(Continued)

*Primary Examiner* — Nathan Durham
(74) *Attorney, Agent, or Firm* — Xsensus LLP

(57) ABSTRACT

A sewing machine that includes a sewing bed on which a plurality of cloth pieces are placed in a manner of being overlaid on each other; a felting needle; a woolen yarn guide provided at a lower end of a safety cover for covering the felting needle; and a device configured to raise and lower the felting needle toward the plurality of overlaid cloth pieces, and the woolen yarn guide is configured to guide a woolen yarn from a bobbin or a woolen yarn ball to a sewing location, and the device is configured to raise and lower the felting needle so that needle felting in which the felting needle is thrusted into the plurality of cloth pieces and the woolen yarn is performed, and thereby the plurality of cloth pieces are sewn together.

13 Claims, 15 Drawing Sheets

(51) Int. Cl.
*D05B 23/00* (2006.01)
*D05B 3/12* (2006.01)

(58) Field of Classification Search
USPC ..... 112/154; 28/107, 108, 115
See application file for complete search history.

(56) References Cited

U.S. PATENT DOCUMENTS

| | | | | |
|---|---|---|---|---|
| 4,353,158 | A * | 10/1982 | Henshaw | D04H 13/00 112/152 |
| 2002/0189516 | A1* | 12/2002 | Kouichi | D05B 37/04 112/220 |
| 2009/0007830 | A1* | 1/2009 | Sakuma | D05B 1/02 112/475.17 |
| 2010/0199899 | A1* | 8/2010 | Sakuma | D05B 1/02 112/170 |
| 2013/0255047 | A1 | 10/2013 | Sasur | |

FOREIGN PATENT DOCUMENTS

| | | |
|---|---|---|
| JP | 58-4556 | 1/1983 |
| JP | 59-177496 | 11/1984 |
| JP | 10-168735 A | 3/1998 |
| JP | 3050335 | 7/1998 |
| JP | 2004-222895 | 8/2004 |
| JP | 2006-274471 | 10/2006 |
| JP | 2014-231655 | 12/2014 |

OTHER PUBLICATIONS

Determination of Objection to maintain Japanese Patent No. 5945050 (Japanese Application No. 2015-189692) by Japanese Patent Office in (11 pages).

Trial Decision issued Jan. 17, 2018 in Japanese Application No. 2017-800054 with English Translation.

Linda Turner Griepentrong and Pauline Wilde Richards, Needle Felting by Hand or Machine, 15 Projects Using Easy-to-Learn Techniques, Krause Publications, 2007.

* cited by examiner

SEWING MACHINE FOR SEWING TOGETHER A PLURALITY OF CLOTH PIECES

CROSS-REFERENCE TO RELATED APPLICATIONS

This application is a continuation of International Application No. PCT/JP2015/086019, filed Dec. 24, 2015, and claims priority to Japanese Application No. 2015-189692, filed Sep. 28, 2015, and Japanese Application No. 2015-060414, filed Mar. 24, 2015, the entire contents of which are incorporated herein by reference.

FIELD

The present disclosure relates to a needle felting sewing machine, a method of sewing together a plurality of cloth pieces, and a sewn object obtained by the same method.

BACKGROUND

In needle felting, for example, a felting needle having a special needle point is thrusted into cloth pieces (threads) for felting such as wool so that the fibers within the cloth pieces for felting are caused to tangle with each other and thereby an embroidery is fabricated (see Patent Document 1 Abstract or the like) or, alternatively, a plurality of nonwoven fabrics (felt pieces) (limited to these) are sewn together (see Patent Document 2 Abstract or the like).

Embroidering performed by such needle felting is easy to be worked. Further, a sewing machine used for this can be inexpensive and hence even a sewing machine for children is sold.

PRIOR ART REFERENCES

Patent Documents

[Patent Document 1] Japanese Laid-Open Patent Publication No. 2014-231655

[Patent Document 2] Japanese Laid-Open Patent Publication No. 2002-302864

SUMMARY

According to one aspect of the disclosure, there is provided a sewing machine comprising: a sewing bed on which a plurality of cloth pieces are placed in a manner of being overlaid on each other; a felting needle; a woolen yarn guide provided at a lower end of a safety cover for covering the felting needle; and a device configured to raise and lower the felting needle toward the plurality of overlaid cloth pieces, wherein the woolen yarn guide is configured to guide a woolen yarn from a bobbin or a woolen yarn ball to a sewing location, and the device is configured to raise and lower the felting needle so that, in a state that the plurality of cloth pieces are overlaid on each other and the woolen yarn is put on the sewing location of the overlaid cloth pieces, needle felting in which the felting needle is thrusted into the plurality of cloth pieces and the woolen yarn is performed, and that fibers of the woolen yarn are caused to tangle with fibers of the plurality of cloth pieces and thereby the plurality of cloth pieces are sewn together.

BRIEF DESCRIPTION OF THE DRAWINGS

FIG. 11(A) is an exploded perspective view; and FIG. 11(B) is a part back view of a rise and fail member portion.

FIG. 12(A) is a part perspective view for explanation; and FIG. 12(B) is a left side view thereof.

FIG. 13A(A) is a part sectional left side view; and FIG. 13A(B) is a part-removed front view thereof.

FIG. 14(A) shows a situation prior to sewing; FIG. 14(B) shows a situation under sewing; and FIG. 14(C) shows a situation posterior to sewing.

FIG. 15(A) a perspective view of a bag; and FIG. 15(B) is a schematic diagram showing a situation a patch has been sewn on.

DETAILED DESCRIPTION

Figure 1:
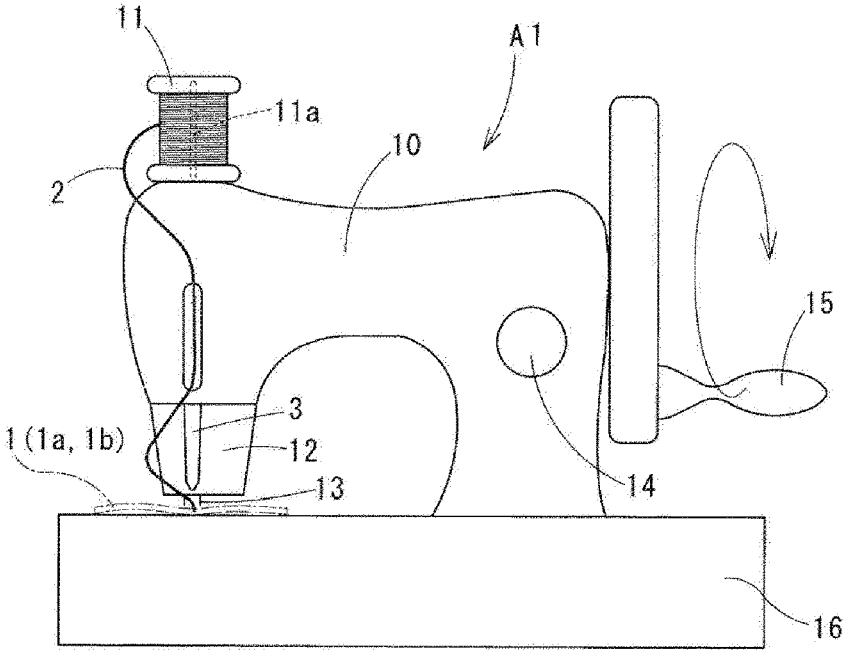
FIG. 1 is a schematic front view of an embodiment of a sewing machine capable of implementing a method of sewing together a plurality of cloth pieces according to the present disclosure.

Problems to be Solved by the Disclosure

The embroidering by needle felting is a technique that a pattern of diverse kind is formed on a clothe or the like by using a cloth piece for felting (a felt cloth piece) such as wool rather than a technique that a plurality of cloth pieces are sewn together.

On the other hand, sewing together of a plurality of cloth pieces by needle felting is a technique that nonwoven fabrics are overlaid and sewn together. In this technique, the fibers of the nonwoven fabrics are caused to tangle with each other so that sewing together is achieved. Thus, a plurality of cloth pieces other than nonwoven fabrics cannot be sewn together.

In view of the above-mentioned situations, an object of the present disclosure to realize sewing together of a plurality of cloth pieces even other than nonwoven fabrics and to realize firmly sewing together.

Means for Solving the Problem

In order that the above-mentioned problem may be solved, the present disclosure has been devised by focusing attention on a fact that n the embroidering by needle felting, the fibers of wool (a woolen yarn) enter into the cloth piece of a clothe or the like so as to tangle with the fibers of the cloth piece and a fact that the fibers of the embroidery thread (the woolen yarn) also tangle with the cloth piece so as to be sewn together so that an embroidery shape is formed. Then, the woolen yarn fibers are utilized as a sewing thread. Specifically, in the employed configuration, a woolen yarn is put on a sewing location where a plurality of cloth pieces are overlaid on each other and then needle felting is performed that a needle is thrusted into the plurality of cloth pieces as well as the woolen yarn, so that the fibers of the woolen yarn are caused to tangle with the fibers of the plurality of cloth pieces and thereby the plurality of cloth pieces are sewn together.

By virtue of this, the woolen yarn fibers can serve as a sewing thread so as to sew together the plurality of cloth pieces. That is, employable to-be-sewn cloth pieces are not limited to nonwoven fabrics and various kinds of cloth pieces can firmly be sewn together. The sewn object obtained by this method is a new one not obtained in the conventional art. Employable woolen yarns include also various kinds of felt threads feasible in needle felting.

A sewing machine employable as one capable of performing the above-mentioned sewing is, for example, a sewing machine comprising: a sewing bed on which the plurality of cloth pieces are placed in a manner of being overlaid on each other; a felting needle; a woolen yarn guide provided at a lower end of a safety cover for covering the felting needle; and means of raising and lowering the felting needle toward the plurality of overlaid cloth pieces, wherein the woolen yarn is guided from a bobbin or a woolen yarn ball to the sewing part (the sewing location) by the guide and then the felting needle is raised and lowered so that the needle felting is performed and thereby the plurality of cloth pieces are sewn together.

At that time, means of feeding the cloth pieces in the sewing direction may be omitted. In a case that this feeding means is not provided, the cloth pieces may be returned in the counter-feeding direction by manual operation and then re-sewing may be performed on a location having been sewn previously or a location having been failed in sewing.

According to this configuration, the woolen yarn serving as a sewing thread is guided from the woolen yarn guide located at the lower end of the safety cover to the sewing part and then the woolen yarn is fed to the sewing part in association with the feeding of the cloth pieces. Thus, a needle thread take-up and the like provided in a common sewing machine become unnecessary. Further, since the felting needle that rises and falls is covered by the safety cover, the felting needle that rises and falls is hard to be touched by a hand or the like so that safety is achieved.

Another configuration of a sewing machine may be employed that a sewing machine housing thereof includes: a leg part rising from an upper face of one end of a base; a horizontal arm part extending from an upper part of the leg part toward the other end of the base; and a head part extending downward from a tip part of the arm part, that the means of raising and lowering the felting needle includes: a horizontal drive shaft revolved by an electric motor; a horizontal drive pin provided at a required position in a direction perpendicular to the drive shaft in an integrated manner with the drive shaft; and a rise and fall member provided with the felting needle and moved vertically, that the rise and fall member includes a horizontal sliding groove in which the drive pin is in an arbitrarily slidable manner so as to rise and fall by virtue of the drive pin and the sliding groove in association with the revolution of the drive shaft, and that the safety cover is provided in a lower part of the sewing machine housing of the head part.

According to this configuration, the felting needle can be raised and lowered by employing a simple configuration. This raising and lowering mechanism for the felting needle may be replaced by well known means such as crank mechanism.

The rise and fall position of the felting needle moved by the rise and fall means can be detected by employing various kinds of well known means in the conventional art. In addition, for example, a pulse motor may be employed as the electric motor and then the number of revolutions of the drive shaft may be calculated from the number of output pulses so that the rise and fall position of the felting needle may be detected on the basis of the calculated value. Alternatively, means including a pulser ring provided coaxially to the drive shaft and a revolution sensor for detecting the number of revolutions of the pulser ring may be employed so that the number of revolutions of the drive shaft may be calculated and then the rise and fall position of the felting needle may be detected on the basis of the calculated value. At that time, the pulser ring and the revolution sensor are provided in the inside of the sewing machine housing.

In a case that a configuration is employed that the rise and fall member provided with the felting needle is provided in a block removable from the sewing machine housing and then the block supports the rise and fall member with a vertical guide shaft in between in a manner permitting arbitrary rise and fall, the felting needle can be replaced when the rise and fall member is merely replaced.

As the woolen yarn guiding path, for example, a guide groove may be provided in an upper face of the tip part of the arm part of the sewing machine housing and then the woolen yarn from the woolen yarn ball may be guided through the guide groove to the woolen yarn guide provided at a lower end of the safety cover.

In a case that the to-be-sewn object placement surface of the base is constructed from a sewing bed provided in the base in a movable manner in vertical directions and then the sewing bed is supported by an elastic member in a manner permitting rise and fall, when the sewing bed is pressed down, the gap in the sewing part located under the felting needle that rises and falls becomes wider so that the cloth pieces can easily be inserted to the sewing part.

Further, a configuration may be employed that a wheel is provided in a rear part of the arm part in a manner permitting arbitrary revolution about a shaft center of the drive shaft and then the wheel is linked through a clutch to the drive shaft in an arbitrarily movable manner in the shaft center direction and then biased in a delinking direction by an elastic member so that the linkage is released by the clutch, and that when the wheel is pushed to the drive shaft side against the elastic member, the wheel and the drive shaft are linked to each other with the clutch in between so as to revolve in an integrated manner with each other.

According to this configuration, unless the wheel is linked to the drive shaft, the felting needle cannot be raised and lowered by manual operation. Thus, during the time that sewing is performed by electric power, the wheel does not revolve and, even when the wheel is turned, a possibility of any kind of trouble is quite hardly caused and hence safety is achieved.

Effect of the Disclosure

The present disclosure employs the above-mentioned configuration. Thus, regardless of the kinds of cloth pieces, a plurality of cloth pieces can easily and firmly be sewn together. Further, the sewing line thereof is formed in the same shape as an embroidery fabricated by needle felting and hence sewing and embroidering of the cloth pieces can simultaneously be achieved.

Figure 3A:
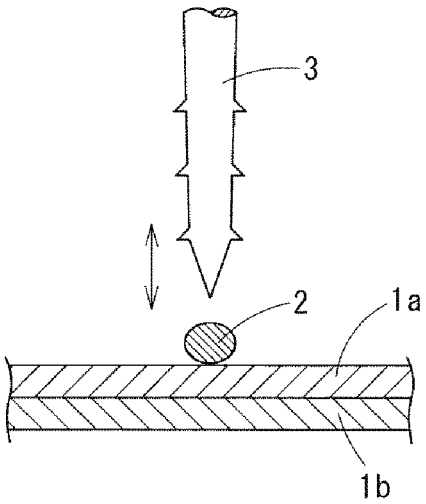
FIG. 3(A) and FIG. 3(B) are operation explanation diagrams for a sewing method in an embodiment described above.
Figure 3B:
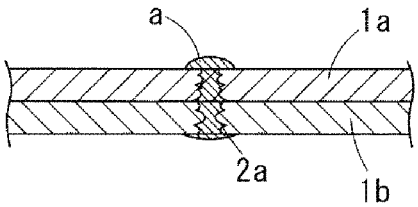
Figure 4A:
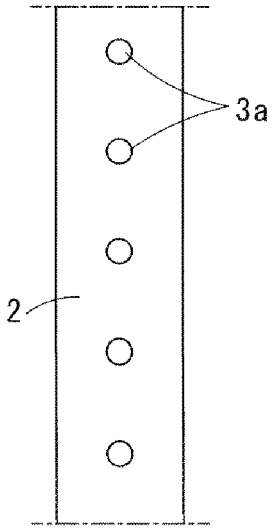
FIG. 4(A), FIG. 4(B), and FIG. 4(C) are explanation diagrams for examples of needle movement of a sewing method described above.
Figure 4B:
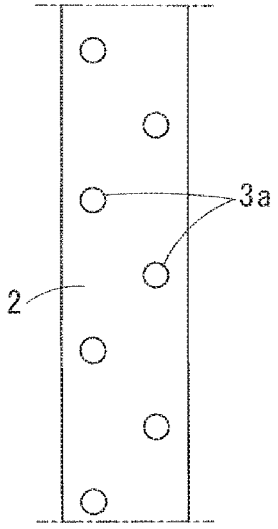
Figure 4C:
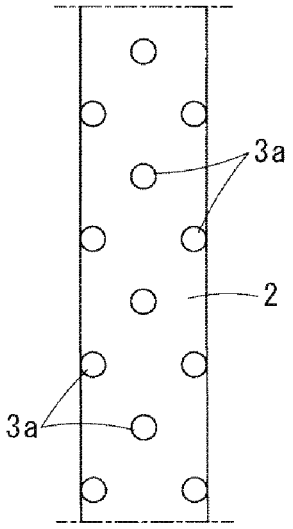
Figure 5:
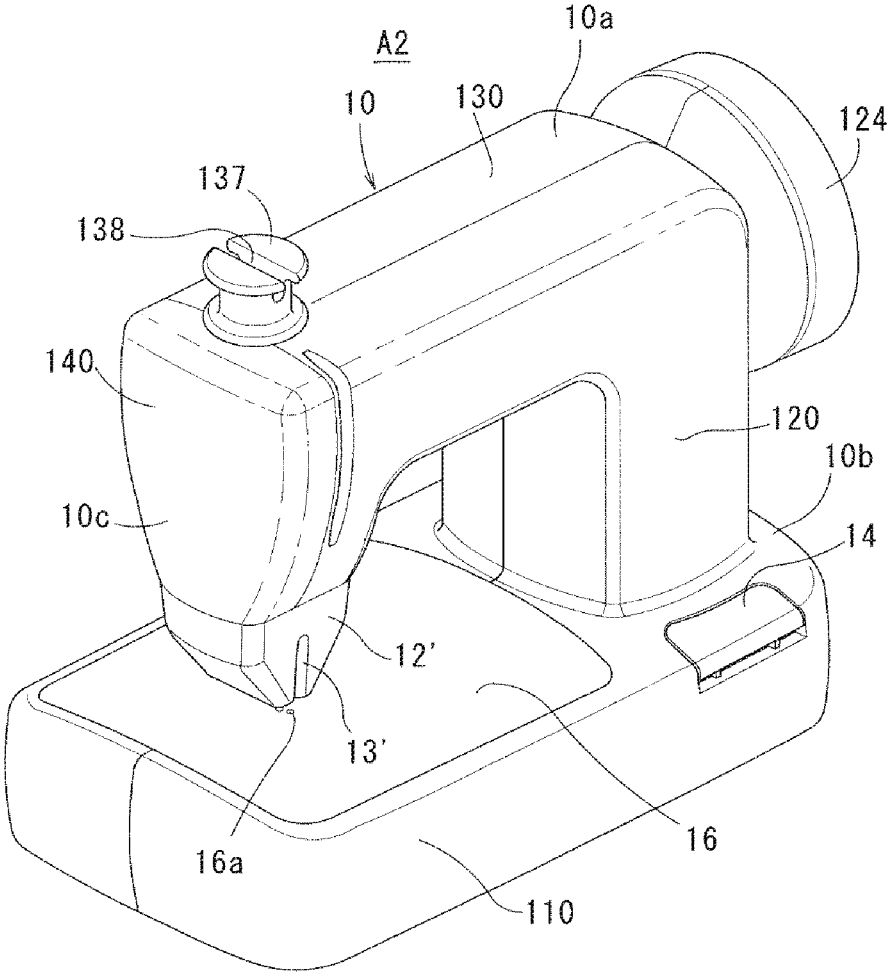
FIG. 5 is a perspective view of another embodiment of a sewing machine capable of implementing a method of sewing together a plurality of cloth pieces according to the present disclosure.
Figure 6:
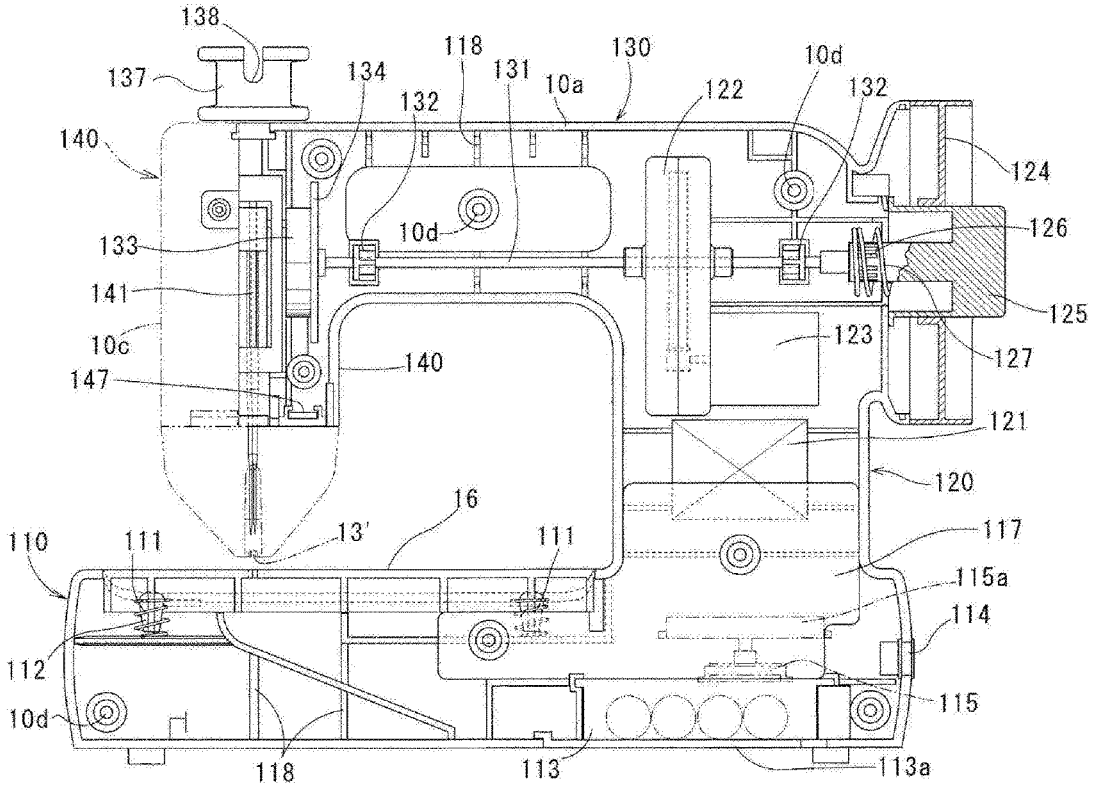
FIG. 6 is a front view in a situation that a part of a sewing machine housing in an embodiment described above is removed.
Figure 7:
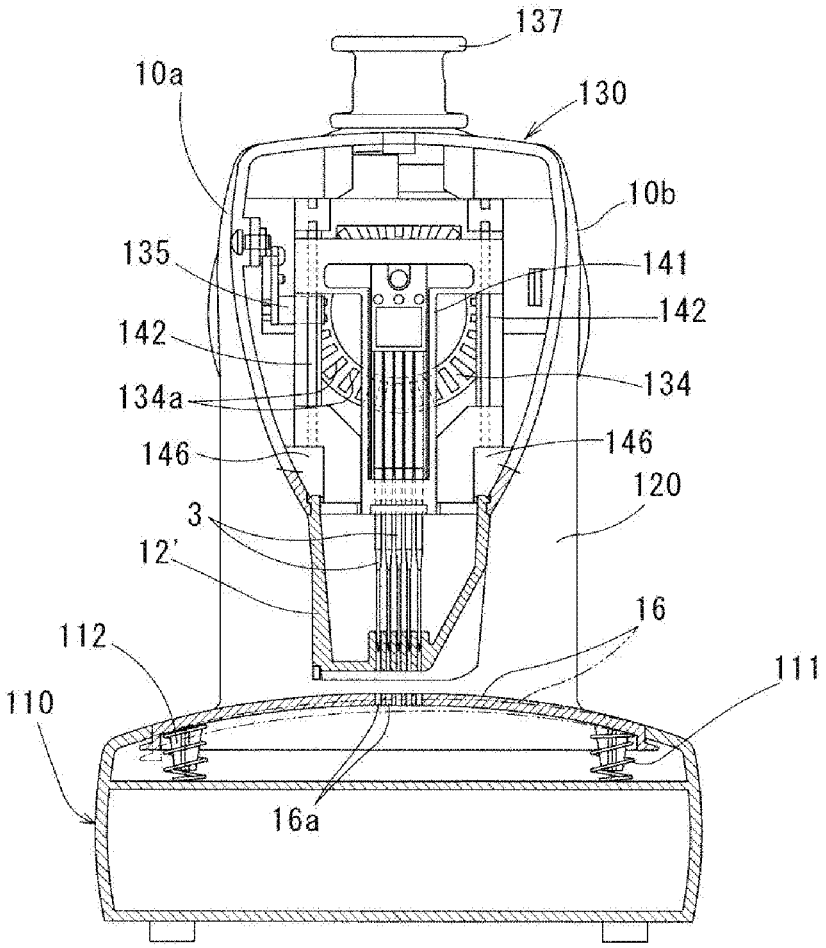
FIG. 7 is a left cut-off side view of an embodiment described above.
Figure 8:
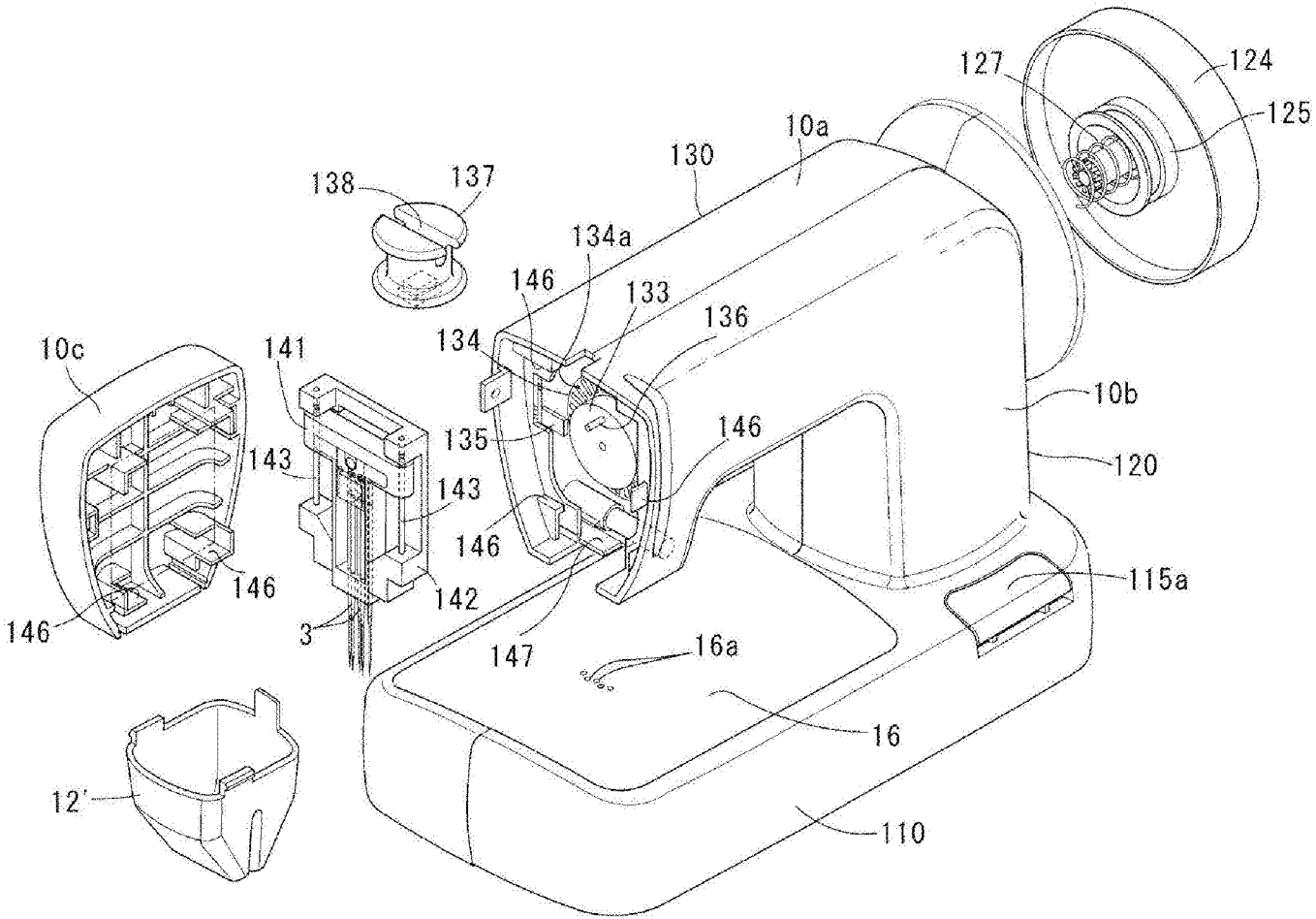
FIG. 8 is a main part exploded perspective view of an embodiment described above.
Figure 9:
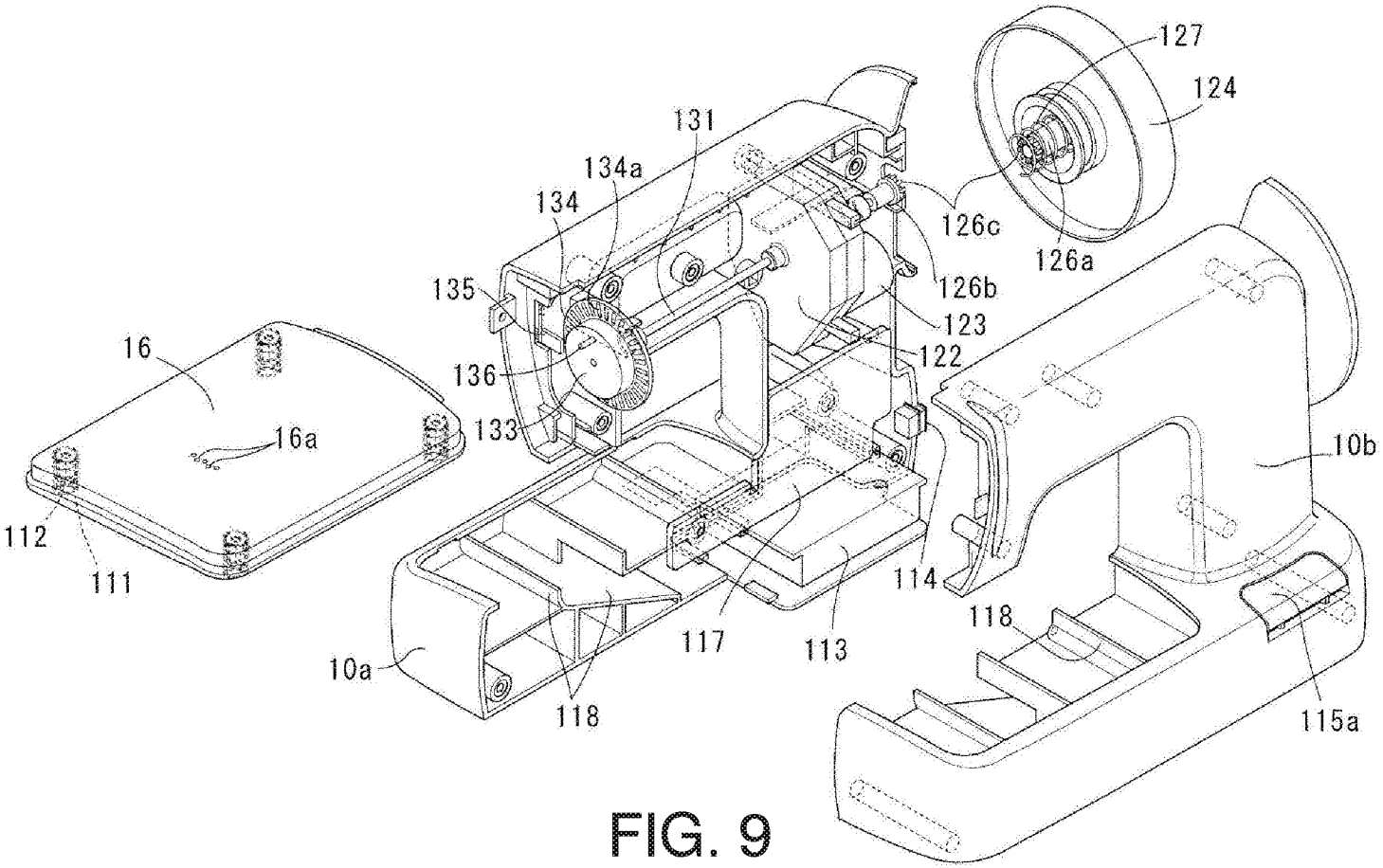
FIG. 9 is a main part exploded perspective view of an embodiment described above.
Figure 10:
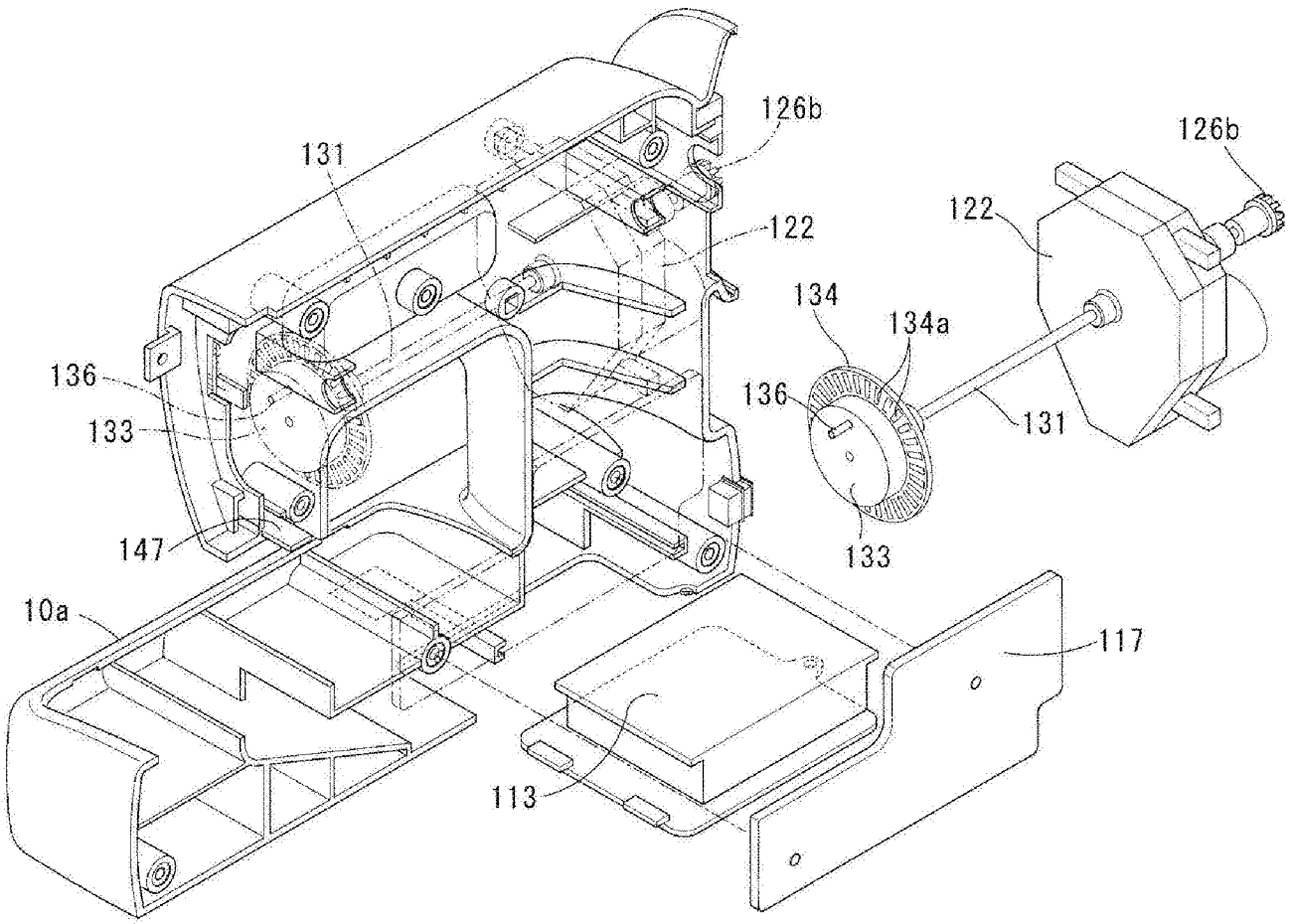
FIG. 10 is a main part exploded perspective view of an embodiment described above.
Figure 11A:
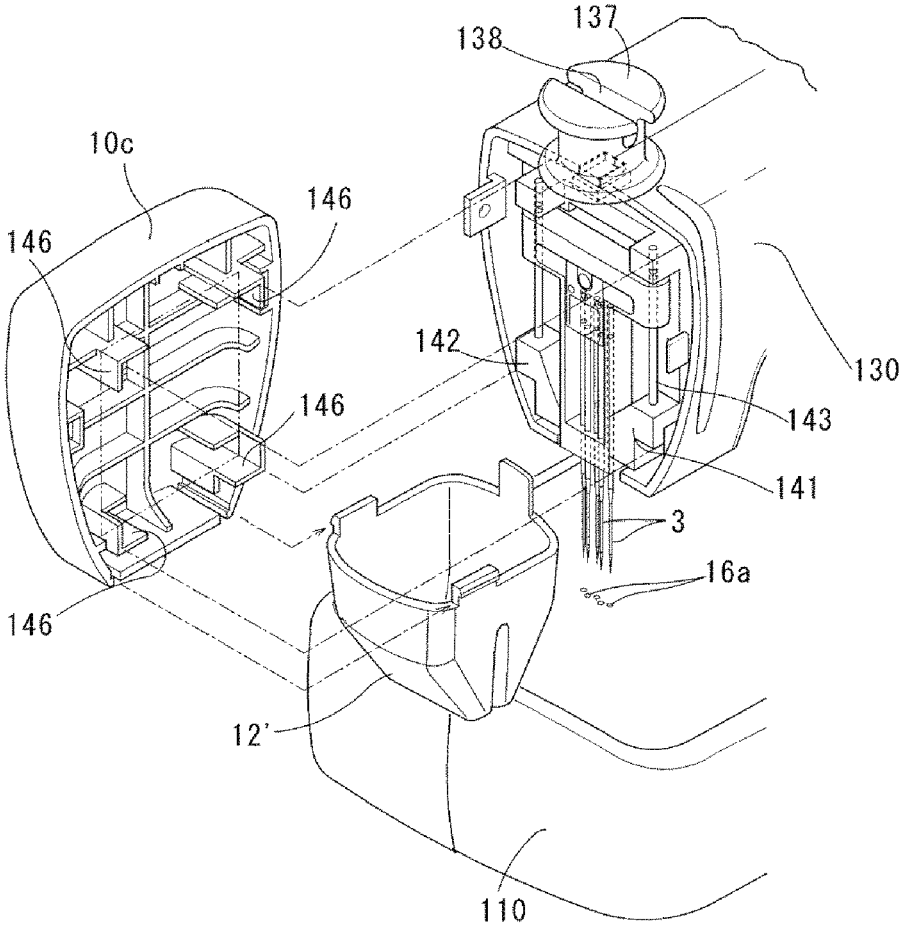
FIG. 11(A) and FIG. 11(B) show a main part of an embodiment described above.
Figure 11B:
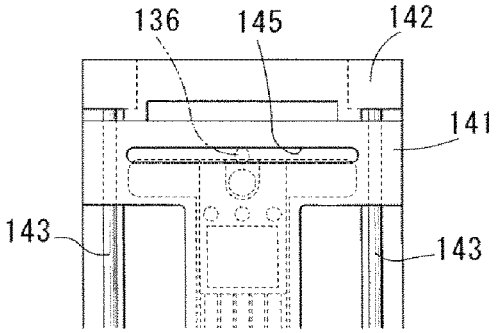

In the method of sewing cloth pieces together according to the present disclosure, as shown in FIG. 3(A), a plurality of cloth pieces 1*a* and 1*b* serving as a to-be-sewn object are overlaid on each other and then a woolen yarn 2 is arranged along the sewing line of the cloth pieces 1*a* and 1*b*. In this state, needle felting that a felting needle 3 is thrusted into the cloth pieces 1*a* and 1*b* as well as the woolen yarn 2 is performed along the woolen yarn 2. As a result of this needle felting, as shown in FIG. 3(B), the woolen yarn fibers 2*a* serves as a sewing thread so as to sew together the cloth pieces 1*a* and 1*b*. In each figure, symbol a indicates a sewing line (a sewing thread) of the woolen yarn 2. At that time, the needle movement 3*a* shown in FIGS. 4(A) to 4(C) may be straight (FIG. 4(A)) relative to the woolen yarn 2 or, alternatively, may be in a zigzag (FIG. 4(B)), in a zigzag in the right and left directions (FIG. 4(C)), or in any other form. The number of felting needles 3 is arbitrary.

Figure 2:
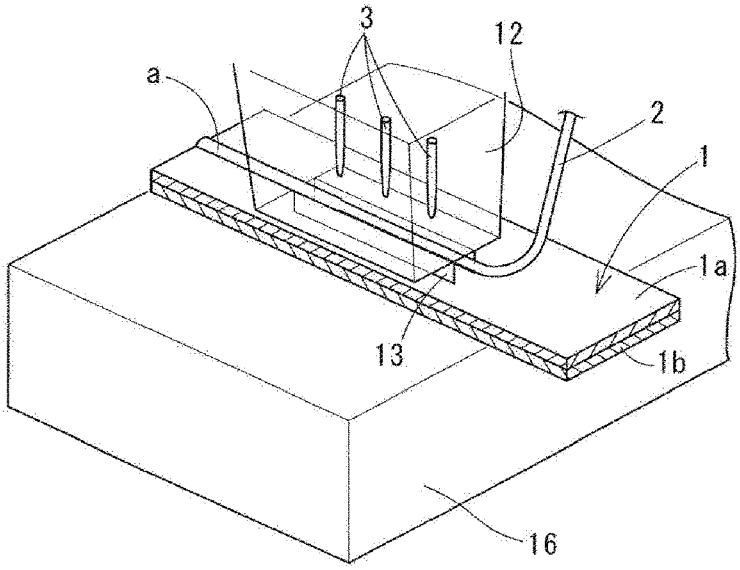
FIG. 2 is a main part perspective view of an embodiment described above.

FIGS. 1 to 2 show an embodiment of a sewing machine capable of implementing this sewing method. This sewing machine A1 is for children.

Figure 12A:
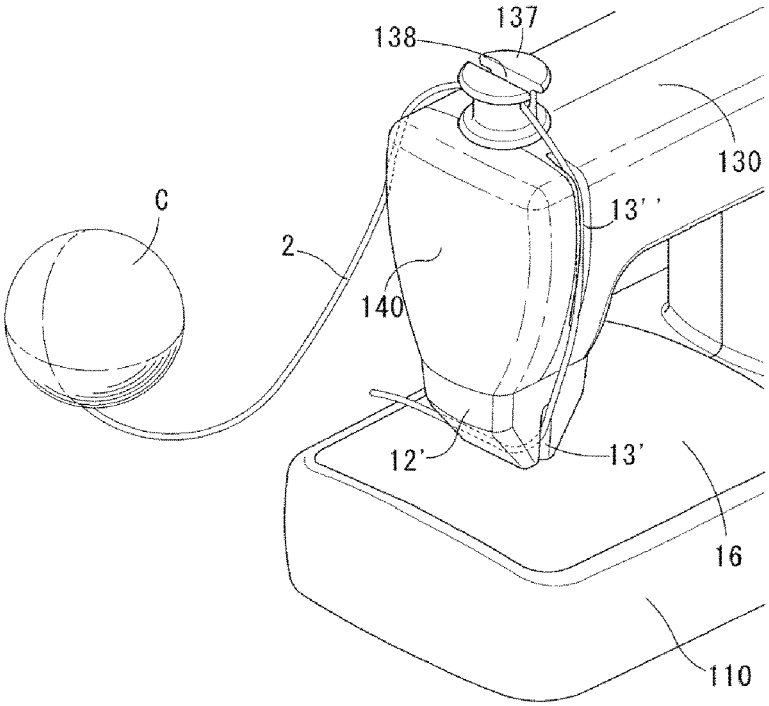
FIG. 12(A) and FIG. 12(B) show an operation of an embodiment described above.

As shown in FIG. 1, the sewing machine A1 includes: a sewing machine body 10; a support rod 11*a* of a bobbin 11 for woolen yarn; a felting needle 3 that rises and falls; a transparent safety cover 12 for covering the felting needle 3; and a guide 13 for the woolen yarn 2 molded integrally with the cover 12 and provided in a lower part of the cover 12. The number of felting needles 3 is arbitrary in the sewing direction. In the present embodiment, three felting needles are employed. The position of arrangement of the support rod 11*a* is not limited to an upper front part of the sewing machine body 10 as shown in the figure. That is, the position of arrangement may be a location on a sewing bed 16 where feeding of the cloth pieces 1 is not disturbed, like a front right side in FIG. 2. In place of the bobbin 11 for woolen yarn, a woolen yarn ball (see symbol "C" in FIG. 12) may be employed. In this case, a guide may be provided in a portion of the sewing machine body 10 where the support rod 11*a* is provided and then the woolen yarn 2 from the woolen yarn ball may be guided through the guide to the sewing part.

In the sewing machine A1, when an auto feed button 14 is pushed, the cloth pieces 1 is auto-fed so that sewing is achieved. Then, when the button 14 is pushed again, the sewing is stopped. Further, when the handle 15 is turned, the felting needles 3 can manually be raised and lowered and the cloth pieces 1 (1*a*, 1*b*) together with the woolen yarn 2 can also be fed. The mechanisms for raising and lowering the felting needles 3, feeding the cloth pieces 1, and the like which are provided in an ordinary sewing machine are similar to those provided in the ordinary sewing machine.

The handle 15 can perform the operation of raising and lowering the felting needles 3 and can avoid this operation by virtue of a mechanism constructed from a later-described clutch coupling 126 or the like.

Here, a main power switch (not shown) constructed from a slide switch or the like is provided at a suitable position of the sewing machine body 10. Then, when the switch is turned on (ON), the sewing machine A1 can be driven.

In order that the plurality of cloth pieces 1 (1*a*, 1*b*) may be sewn together by the sewing machine A1, as shown in FIG. 2, the cloth pieces 1 are placed on the sewing bed 16 of the sewing machine A1 in a manner of being overlaid on each other and then the woolen yarn 2 is guided by the guide 13 such as to extend along the sewing line of the cloth pieces 1. In this state, when the felting needles 3 are raised and lowered and the cloth pieces 1 are fed at the same time, as described above, needle felting that the felting needles 3 are thrusted into the cloth pieces 1*a* and 1*b* as well as the woolen yarn 2 is performed along the woolen yarn 2. As a result, as shown in FIG. 3(B), the woolen yarn fibers 2*a* serve as a sewing thread a so that the cloth pieces 1*a* and 1*b* are sewn together. The number of cloth pieces 1 is not limited to two and may be arbitrary like three as long as sewing together is achievable.

FIGS. 5 to 14 show a sewing machine A2 of another embodiment. The sewing machine A2 of the present embodiment is also for children and a part of mechanisms provided in an ordinary sewing machine like feeding of the cloth pieces 1 is omitted. That is, similarly to a common sewing machine, the sewing machine body 10 include: a base 110 constituting the sewing bed 16; a leg part 120 rising from an upper face of one end of the base 110; a horizontal arm part 130 extending from an upper part of the leg part 120 toward the other end of the base 110; and a head part 140 extending downward from a tip part of the arm part 130. In side view (viewed from left in FIG. 6), the sewing machine body 10 includes: a pair of case-shaped sewing machine housing (simply referred to as a "housing", hereinafter; similar notation is employed in the following description) 10*a* and 10*b* divided by a mid-plane in the right and left directions; and a lid housing 10*c* thereof. These housings 10*a*, 10*b*, and 10*c* are fabricated by resin molding. Then, reinforcing ribs 118 are suitably provided and then screws are attached into screw holes 10*d* so that the sewing machine body 10 is constructed.

In addition to the ribs 118, the individual housings 10*a*, 10*b*, and 10*c* are provided with reinforcing boards 117 so that reinforcement is achieved.

The base 110 has a flattened box shape. Then, the upper face thereof constitutes the sewing bed 16. The sewing bed 16 is plate-shaped and biased upward by coil springs (elastic members) 111 so as to be positioned at the same height as the peripheral upper face of the base 110 in the periphery of the sewing bed 16. Further, the downward positioning thereof achieved by spring shafts 112 (see FIG. 6). Thus, when the cloth pieces 1*a* and 1*b* are to be inserted between the sewing bed 16 and the guide 13' (the cover 12'), the sewing bed 16 may be pressed down against the coil springs 111 so that the insertion can smoothly be performed. Further, at the time of sewing by the felting needles 3, the sewing bed 16 is not largely lowered by a pressing force from the felting needles 3 so that the sewing is not disturbed. Needle holes 16*a* into which the felting needles 3 are inserted are formed in the sewing bed 16 (see FIGS. 5 and 11).

The raising and lowering mechanism of the sewing bed 16 may be omitted and then the sewing bed 16 may be molded integrally with the base 110.

A battery box 113 is provided in the inside of the base 110. Then, when a bottom plate 113*a* thereof is removed and then the battery box 113 is pulled out, the battery can be changed. Further, a DC (direct current) terminal 114 is provided in a side wall of the base 110 and then a DC power can be supplied through the DC terminal 114 similarly to a battery. The DC terminal 114 may be omitted or, in contrast, the DC terminal 114 alone may be provided without providing the battery box 113.

Here, when a DC power is supplied to the DC terminal 114, electric power supply from the battery is stopped. Then, when the supply through the former is stopped, electric power supply from the battery is allowed. This switching is performed by a control circuit (a controller) of a control board 121 described later.

In front of the rising base part of the leg part 120 of the base 110, a switch board 115*a* is provided in a manner permitting arbitrary rise and fall. Then, a tactile switch 115 is located there under in the inside of the base 110. Thus, when the switch board 115*a* is pushed, the switch 115 goes ON so that a circuit of the control board 121 is prompted to start the driving of the sewing machine A2. Then, when the switch is pushed again, the driving is stopped. In place of the tactile switch 115, a position holding type switch such as an alternate switch and a push lock switch or any other switch may be employed.

Here, a main power switch (not shown) constructed from a slide switch or the like is provided at a suitable position of the sewing machine body 10, for example, in a back face (an inner face) of the rising base part of the leg part 120 of the base 110. Then, when the switch is turned on (ON), the sewing machine A2 can be driven.

A control board (a controller) 121 including a control circuit is provided in a middle of the leg part 120. Then, the control board (the control circuit) 121 controls the operation of the sewing machine A2.

A continuous part between the leg part 120 and the arm part 130 is provided with: a gearbox 122; an electric motor (a motor) 123; a disk-shaped wheel 124 having similar operation to the handle 15; and the like. The gearbox 122 includes a deceleration mechanism constructed such that spur gears aligned in parallel to each other engage with each other. Further, the electric motor 123 is attached to the gearbox 122. Then, the driving of the electric motor 123 is slowed down by the deceleration mechanism constructed from the spur gears, so that the drive shaft 131 revolves at a necessary revolution speed.

The wheel 124 includes a cylinder-shaped push button 125 provided in the center. The button 125 is provided integrally with the wheel 124 in the rotation direction and in an arbitrarily movable manner in the axial direction. Further, the button 125 is linked through the clutch coupling 126 to the drive shaft 131. The clutch coupling 126 is constructed such that a pair of members 126*a* and 126*b* provided with protruding teeth 126*c* arranged in the periphery at regular intervals can engage with each other through the protruding teeth 126*c* and can be disconnected from each other (see FIGS. 6 and 9).

A coil spring (an elastic member) 127 is provided between the pair of members 126*a* and 126*b* of the clutch coupling 126. Then, the two members 126*a* and 126*b* are always disconnected from each other by the coil spring 127 (the clutch coupling 126 is in an off (OFF) state) so that the wheel 124 and the drive shaft 131 are in a delinked state. From this state, when the button 125 is pushed against the coil spring 127, the pair of members 126*a* and 126*b* (the protruding teeth 126*c*) of the clutch coupling 126 engage with each other so that the wheel 124 and the drive shaft 131 go into a linked state. Thus, when the wheel 124 is turned in a state that the button 125 is pushed, the drive shaft 131 revolves.

Here, a configuration may be employed that when the button 125 is pushed once, the clutch coupling 126 goes on (ON) so that the wheel 124 and the drive shaft 131 are linked to each other and then, when the button 125 is pushed further, the clutch coupling 126 goes off so that the wheel 124 and the drive shaft 131 are delinked from each other.

The drive shaft 131 is supported through bearings 132 by the housings 10*a* and 10*b* of the arm part 130 in a manner permitting arbitrary revolution. Then, a drive plate 133 is fixed coaxially to the tip of the drive shaft 131. Further, a coaxial pulser ring 134 is formed on the outer periphery of the drive plate 133. In the pulser ring 134, slits 134*a* are formed at equal intervals over the entire circumference. Then, the slits 134*a* are detected by a revolution sensor 135 of light emitting/receiving integrated type fixed to the housing so that the number of revolutions of the drive plate 133 (the drive shaft 131) is detected on the basis of the number of detection of the slits 134*a* in association with the revolution of the drive plate 133. In the detection of the number of revolutions, detection signals of the slits 134*a* are transmitted from the revolution sensor 135 to the control circuit (the control board 121) so that the number of slit detection is calculated. Then, the control of upper end stop of the felting needles 3 is performed on the basis of the calculated value. That is, control is performed such that at the time of stop of the electric motor 123 (at the time of end of sewing operation), the felting needles 3 may be located at the top level (FIG. 13A) of the rise and fall stroke.

Here, the rotation angle or the revolution speed of the drive plate 133 may be detected on the basis of the detection of the slits 134*a* performed by the revolution sensor 135 and then the rise and fall speed or the rise and fall position of the felting needles 3 may be recognized on the basis of the detected value so that optimal sewing may be achieved.

The employed revolution sensor 135 may be a sensor whose light projector and photo detector are separate from each other, for example, a groove type sensor whose holding frame is in a U-shape. The mode of attachment of the groove type sensor is such that the peripheral part of the pulser ring 134 is located in a gap of the U-shaped frame and then light projected from the light projector provided at one end of the U-shaped frame is received by the photo detector provided at the other end.

A drive pin 136 protruding horizontally is provided on the front face of the drive plate 133. Further, a guide member 137 for the woolen yarn a is fixed to the upper face of the tip part of the arm part 130 so that the woolen yarn a from the woolen yarn ball C is guided to the guide groove 138 of the guide member 137.

A rise and fall member 141 including the felting needles 3 is provided in the housings 10*a*, 10*b*, and 10*c* constituting the head part 140. The rise and fall member 141 is attached through guide shafts 143 to a quadrangular support frame (a block) 142 in a manner permitting arbitrary rise and fall. Further, a sliding groove 145 in a horizontal direction is formed in the back face of the rise and fall member 141 (see FIG. 11(B)) and then the drive pin 136 is fit in the sliding groove 145 in a manner of not moving vertically relative to the sliding groove 145. Thus, when the drive pin 136 revolves about the drive shaft 131, the position of the drive pin 136 in the inside of the sliding groove 145 moves in a horizontal direction in association with the revolution of the drive pin 136 so that the rise and fall member 141 rises and falls in association with this and also the felting needles 3 rise and fall (see FIGS. 13A, 13B, and 13C).

The rise and fall length (the distance) of the felting needles 3 is determined by the position of the drive pin 136 from the rotational center of the drive plate 133. Further, the uppermost position and the lowermost position of the felting needles 3 are determined, in addition to the rise and fall length, by the vertical position of the sliding groove 145 relative to the rise and fall member 141 and by the position of attachment of the felting needles 3 to the rise and fall member 141. Then, in order that suitable sewing may be achieved, these positions are suitably set up on the basis of experiments or the like. The sliding groove 145 may be a hole going through the rise and fall member 141.

The support frame 142 is fit within individual ribs 146 in the tip surfaces of the housings 10*a* and 10*b* of the arm part 130. After that, the lid housing 10*c* is fit in the tip surfaces of the housings 10*a* and 10*b* and then fixed with screws so that the support frame 142 is fixed to the inside of the housings 10*a*, 10*b*, and 10*c* (the head part 140). As such, since the support frame 142 is attached to the housing by insertion, when the felting needles 3 are to be replaced at the time of breakage or the like, the lid housing 10*c* may be removed and then the support frame 142 may be replaced into one provided with new (brand new) felting needles 3 so that the felting needles 3 can be replaced.

A transparent cover 12' equivalent to the above-mentioned transparent cover 12 is attached to a lower part the lid housing 10*c* by insertion. Then, a guide groove (a guide) 13' is formed and extending from the front face to the lower face of the cover 12' (see FIG. 12(A)). The woolen yarn 2 from the guide groove 138 of the guide member 137 is guided to the guide groove 13' and a guide groove (a guide) 13" in the upper front part of the head part 140 and then pulled out frontward (see FIG. 12(A)).

Further, a light emitting diode 147 is provided in a lower part of the lid housing 10*c* (see FIGS. 6 and 8) and then light emitted from the light emitting diode 147 is projected through the cover 12' onto the sewing part.

Figure 12B:
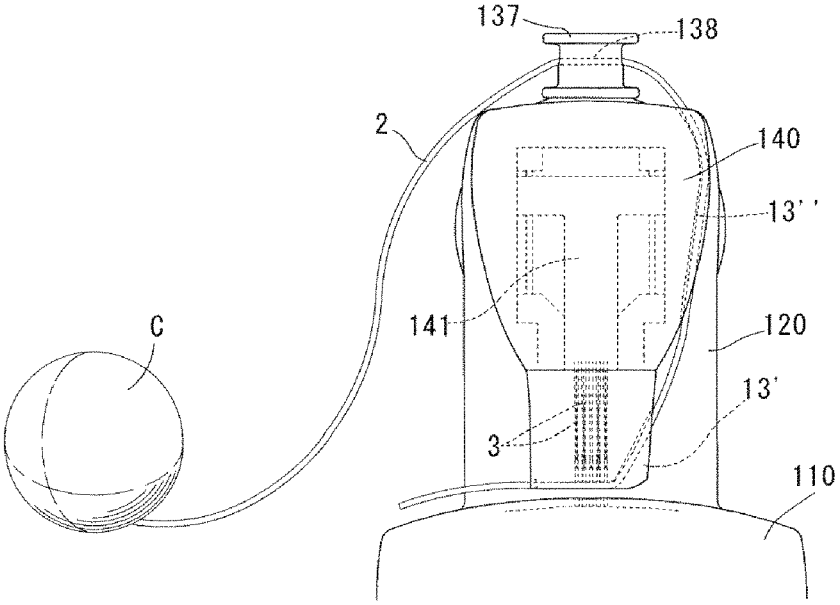
Figure 13A:
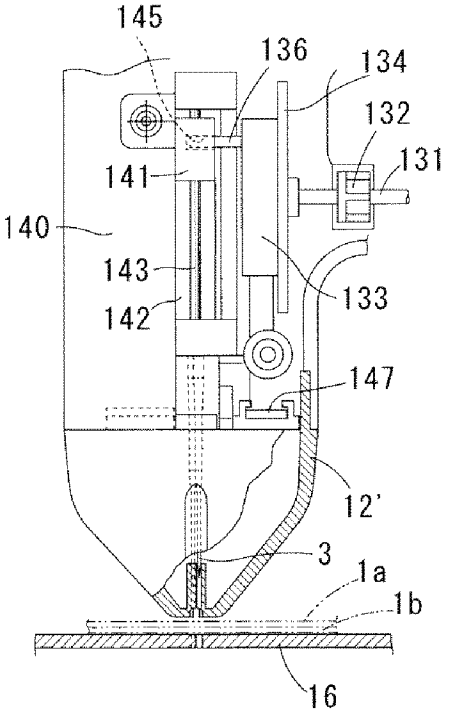
FIG. 13A(A) and FIG. 13A(B) show an operation of an embodiment described above.
Figure 13A:
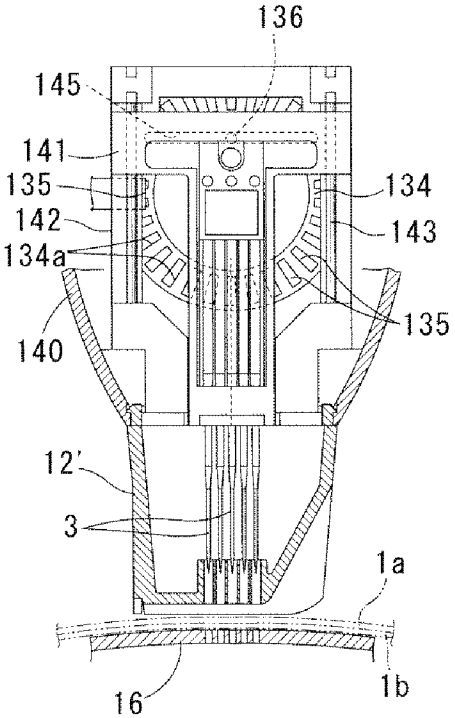
Figure 13C:
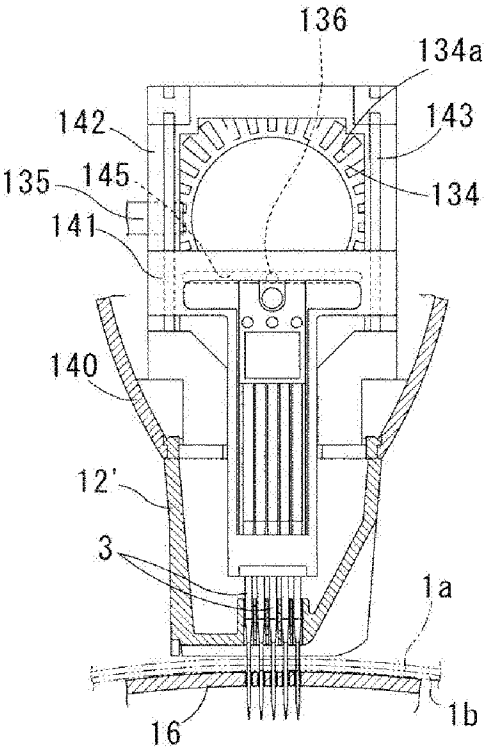
FIG. 13C is a part sectional left side view showing an operation of an embodiment described above.
Figure 13B:
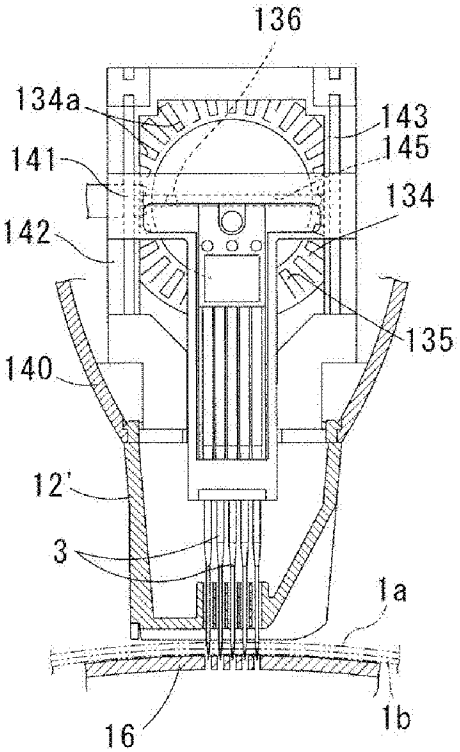
FIG. 13B is a part sectional left side view showing an operation of an embodiment described above.

The sewing machine A2 of the present embodiment has the above-mentioned configuration. Then, in a state that the woolen yarn 2 has been guided from the woolen yarn ball C to the guide grooves 138, 13", and 13' as shown in FIG. 12, the cloth pieces 1 (1*a*, 1*b*) are placed on the sewing bed 16 as shown in FIG. 13A. The woolen yarn 2 may be guided after the cloth pieces 1 are placed.

Figure 14A:
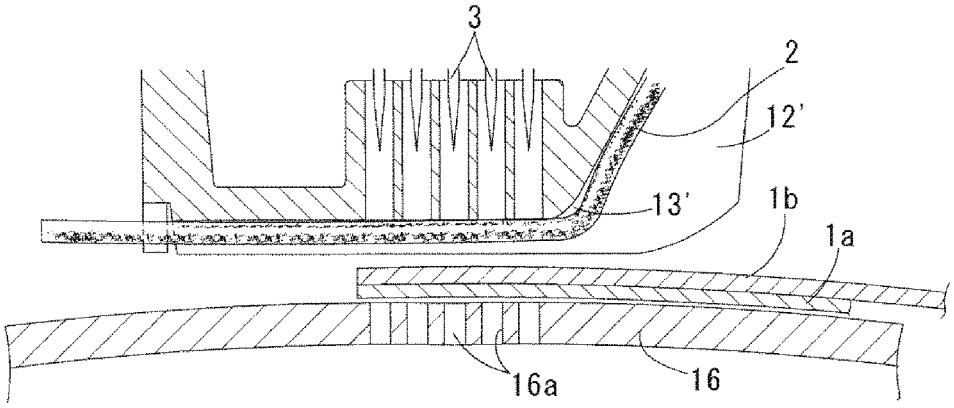
FIG. 14(A), FIG. 14(B), and FIG. 14(C) show a sewing operation of an embodiment described above.
Figure 14B:
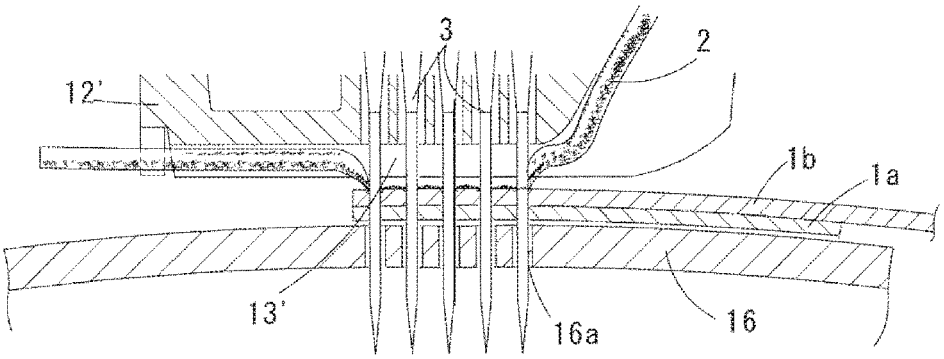
Figure 14C:
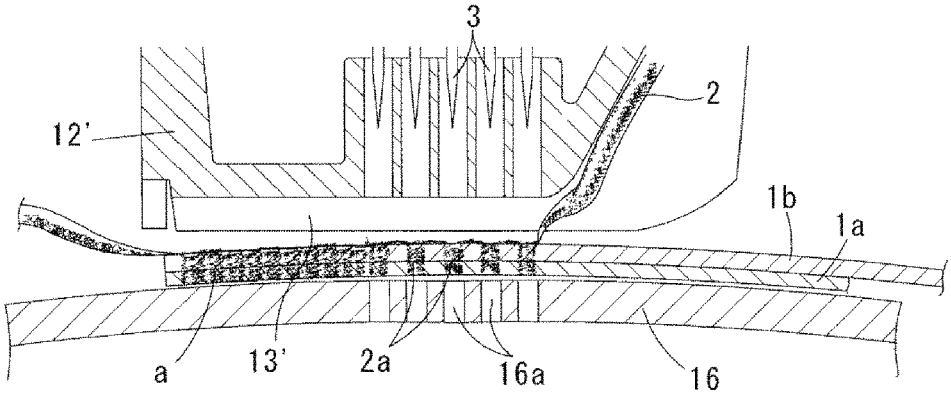

In this state, when the switch board 115*a* is pushed, the electric motor 123 operates so that the drive shaft 131 revolves. As a result, the mode of FIG. 13A→FIG. 13B→FIG. 13C→FIG. 13B→FIG. 13A→ . . . is repeated so that the felting needles 3 rises and falls. Then, in the course of the rise and fall, when the cloth pieces 1 are fed by hand, as shown in FIGS. 14(A) to 14(C), needle felting that the felting needles 3 are thrusted into the cloth pieces 1*a* and 1*b* as well as the woolen yarn 2 is performed along the woolen yarn 2. As a result, the woolen yarn fibers 2*a* serve as a sewing thread a so that the cloth pieces 1*a* and 1*b* are sewn together.

Figure 15A:
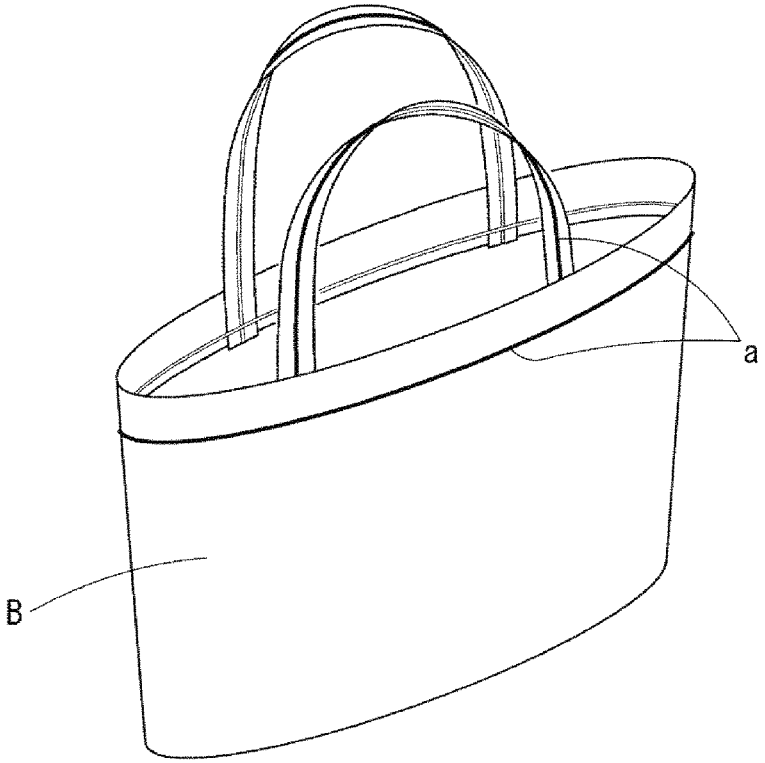
FIG. 15(A) and FIG. 15(B) show a sewn object obtained by a sewing method described above.
Figure 15B:
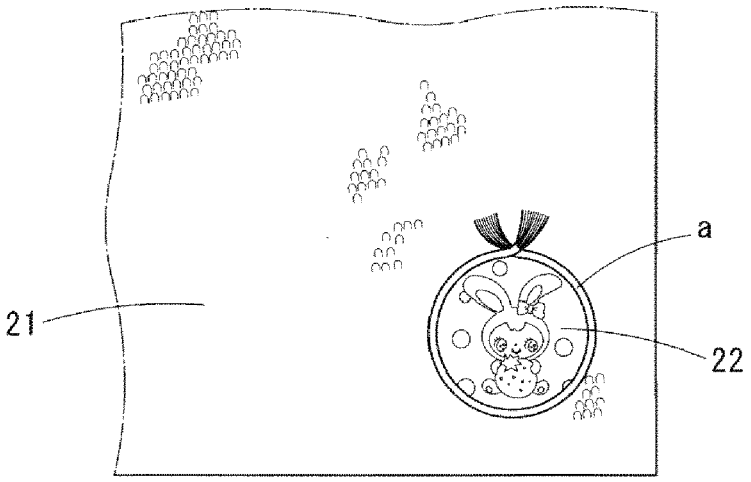

In the sewing by these sewing machines A1 and A2, for example, as shown in FIG. 15(A), in a bag B, the opening thereof is turned up and stitched or, alternatively, the turn-up edge of the handle is sewn together. Further, as shown in FIG. 15(B), a printed fabric 22 is applied on the outer material of the bag B, the outer material 21 of a clothe, or the like and then needle felting is performed such that the woolen yarn 2 may extend along the periphery of the printed fabric 22 so that the printed fabric 22 is sewn onto the outer material 21. Employable outer materials include various kinds of cloth pieces such as a pile fabric.

In the embodiments given above, the sewing machines A1 and A2 for children have been employed. However, it is obvious that the present disclosure may be applied also to a common sewing machine. At that time, in the sewing machine A2, the DC terminal 114 may be omitted in a sewing machine for children. Then, in a general-use sewing machine (for adults), both the battery box 113 and the DC terminal 114 may be provided or, alternatively, the DC terminal 114 alone may be provided.

Further, in the present disclosure, a high sewing strength is obtained when sewing is performed by using the woolen yarn 2. Thus, felting by the felting needles 3 from the upward alone is sufficient as in the embodiments given above. However, separate felting needles that rise and fall on the sewing bed 16 may be provided in the base 110 so that sewing may be performed by using the upper and lower felting needles. In the embodiment shown in FIGS. 1 to 4, the feed mechanism may be not provided and then the cloth pieces 1 may be fed by hand. On the other hand, in the embodiment shown in FIGS. 5 to 14, a cloth piece feed mechanism may be provided in the base 110 or the like so that the cloth pieces 1 may be fed automatically.

As such, the embodiments disclosed in the present specification shall be recognized as illustrative and not restrictive at all points. The scope of the present disclosure is defined by the claims and intended to encompass all changes belonging to the spirit and the scope equivalent to those of the claims.

DESCRIPTION OF REFERENCE NUMERALS

A1, A2 sewing machine
B bag
a sewing line (sewing thread)
1, 1*a*, 1*b* to-be-sewn cloth piece
2 woolen yarn
2*a* woolen yarn fibers
3 felting needle
10 sewing machine body
10*a*, 10*b*, 10*c* sewing machine housing constituting sewing machine body
11 bobbin for woolen yarn
11*a* bobbin support rod
12, 12' safety cover
13, 13', 13" woolen yarn guide (guide groove)
14 auto feed button
15 handle
16 sewing bed of sewing machine
21 outer material serving as to-be-sewn object
22 printed fabric serving as to-be-sewn object
110 base of sewing machine body
111 coil spring for sewing bed
113 battery box
114 DC power supply terminal
115 switch
115*a* switch board
120 leg part of sewing machine body
121 control board (control circuit)
122 reduction gearbox
123 electric motor (motor)
124 manual wheel

125 button of manual wheel
126 clutch coupling
127 spring for clutch
130 arm part of sewing machine body
131 drive shaft
132 bearing for drive shaft
133 drive plate
134 pulser ring
134*a* slit of pulser ring
135 revolution sensor
136 drive pin
138 guide groove
140 head part of sewing machine body
141 rise and fall member including felting needle
142 support frame for rise and fall member (block)
143 guide shaft for rise and fall member
144 light emitting diode
145 sliding groove

The invention claimed is:

1. A sewing machine comprising:
a sewing bed on which a plurality of cloth pieces are placed is a manner of being overlaid on each other;
a felting needle;
a woolen yarn guide provided at a lower end of a safety cover for covering the felting needle; and
a device configured to raise and lower the felting needle toward the plurality of overlaid cloth pieces, wherein
the woolen yarn guide is configured to guide a woolen yarn from a bobbin or a woolen yarn ball to a sewing location,
the woolen yarn guide includes a groove extending in a horizontal direction parallel to the sewing bed and having opposing open ends such that the woolen yarn guided by the groove extends in the horizontal direction parallel to the sewing bed, and
the device is configured to raise and lower the felting needle so that, in a state that the plurality of cloth pieces are overlaid on each other and the woolen yarn is put on the sewing location of the overlaid cloth pieces, needle felting in which the felting needle is thrusted into the plurality of cloth pieces and the woolen yarn is performed, and that fibers of the woolen yarn are caused to tangle with fibers of the plurality of cloth pieces and thereby the plurality of cloth pieces are sewn together.

2. The sewing machine according to claim 1, further comprising:
a sewing machine housing including
a leg rising from an upper face of one end of a base of the sewing machine;
a horizontal arm extending from an upper part of the leg toward the other end of the base; and
a head extending downward from a tip part of the arm, wherein
the device includes:
a horizontal drive shaft revolved by an electric motor, the horizontal drive shaft extending in a first axis;
a horizontal drive pin provided in an integrated manner with the drive shaft, the horizontal drive pin extending in a second axis parallel to the first axis, the second axis being offset from the first axis; and
a rise and fail member provided with the felting needle and configured to move vertically,
the drive shaft and the rise and fall member are provided in an inside of the sewing machine housing,
the rise and fall member includes a horizontal sliding groove in which the drive pin is fit in a slidable manner so as to rise and fall via the drive pin and the sliding groove in association with revolution of the drive shaft, and
the safety cover is provided in a lower part of the sewing machine housing of the head part.

3. The sewing machine according to claim 2, further comprising:
a pulser ring provided coaxially to the drive shaft; and
a revolution sensor configured to detect a number of revolutions of the pulser ring, wherein
the pulser ring and the revolution sensor are provided in the inside of the sewing machine housing.

4. The sewing machine according to claim 2, wherein
the rise and fall member provided with the felting needle is provided in a block removable from the sewing machine housing, and
the block supports the rise and fall member with a vertical guide shaft in between in a manner permitting rise and fall of the rise and fall member.

5. The sewing machine according to claim 2, wherein
the bobbin or the woolen yarn ball is the woolen yarn ball,
the sewing machine further comprises a guide groove for guiding the woolen yarn pulled out from the woolen yarn ball, the guide groove being provided in an upper face of a tip part of the arm of the sewing machine housing, and
the woolen yarn from the woolen yarn ball is guided through the guide groove to the woolen yarn guide.

6. The sewing machine according to claim 2, wherein
the sewing bed is provided in the base in a vertically movable manner, and
the sewing bed is supported by an elastic member in a manner permitting rise and fall of the sewing bed.

7. The sewing machine according to claim 2, further comprising:
a wheel provided in a rear part of the arm in a manner permitting revolution about a shaft center of the drive shaft, wherein
the wheel is linked through a clutch coupling to the drive shaft in a movable manner in a shaft center direction of the drive shaft,
the wheel is biased in a delinking direction by an elastic member so that the linkage is released by the clutch coupling, and
the wheel and the drive shaft are configured to be linked to each other with the clutch coupling in between so as to revolve in an integrated manner with each other when the wheel is pushed to a side of the drive shaft against the elastic member.

8. A sewing machine comprising:
a sewing bed on which a plurality of cloth pieces are placed is a manner of being overlaid on each other;
a felting needle;
a woolen yarn guide provided at a lower end of a safety cover for covering the felting needle; and
a device configured to raise and lower the felting needle toward the plurality of overlaid cloth pieces, wherein
the woolen yarn guide is configured to guide a woolen yarn from a bobbin or a woolen yarn ball to a sewing location,
the device is configured to raise and lower the felting needle so that, in a state that the plurality of cloth pieces are overlaid on each other and the woolen yarn is put on the sewing location of the overlaid cloth pieces, needle felting in which the felting needle is thrusted into the plurality of cloth pieces and the woolen yarn is performed, and that fibers of the woolen yarn are caused to tangle with fibers of the plurality of cloth pieces and thereby the plurality of cloth pieces are sewn together, the sewing machine further comprises:

a sewing machine housing including a leg rising from an upper face of one end of a base of the sewing machine;

a horizontal arm extending from an upper part of the leg toward the other end of the base; and a head extending downward from a tip part of the arm, the device includes:

a horizontal drive shaft revolved by an electric motor, the horizontal drive shaft extending in a first axis;

a horizontal drive pin provided in an integrated manner with the drive shaft, the horizontal drive pin extending in a second axis parallel to the first axis, the second axis being offset from the first axis; and a rise and fail member provided with the felting needle and configured to move vertically, the drive shaft and the rise and fall member are provided in an inside of the sewing machine housing, the rise and fall member includes a horizontal sliding groove in which the drive pin is fit in a slidable manner so as to rise and fall via the drive pin and the sliding groove in association with revolution of the drive shaft, and the safety cover is provided in a lower part of the sewing machine housing of the head part.

9. The sewing machine according to claim 8, further comprising:

a pulser ring provided coaxially to the drive shaft; and a revolution sensor configured to detect a number of revolutions of the pulser ring, wherein the pulser ring and the revolution sensor are provided in the inside of the sewing machine housing.

10. The sewing machine according to claim 8, wherein the rise and fall member provided with the felting needle is provided in a block removable from the sewing machine housing, and the block supports the rise and fall member with a vertical guide shaft in between in a manner permitting rise and fall of the rise and fall member.

11. The sewing machine according to claim 8, wherein the bobbin or the woolen yarn ball is the woolen yarn ball, the sewing machine further comprises a guide groove for guiding the woolen yarn pulled out from the woolen yarn ball, the guide groove being provided in an upper face of a tip part of the arm of the sewing machine housing, and the woolen yarn from the woolen yarn ball is guided through the guide groove to the woolen yarn guide.

12. The sewing machine according to claim 8, wherein the sewing bed is provided in the base in a vertically movable manner, and the sewing bed is supported by an elastic member in a manner permitting rise and fall of the sewing bed.

13. The sewing machine according to claim 8, further comprising:

a wheel provided in a rear part of the arm in a manner permitting revolution about a shaft center of the drive shaft, wherein the wheel is linked through a clutch coupling to the drive shaft in a movable manner in a shaft center direction of the drive shaft, the wheel is biased in a delinking direction by an elastic member so that the linkage is released by the clutch coupling, and the wheel and the drive shaft are configured to be linked to each other with the clutch coupling in between so as to revolve in an integrated manner with each other when the wheel is pushed to a side of the drive shaft against the elastic member.

* * * * *